US007694713B2

(12) United States Patent
Martinez Sanchez et al.

(10) Patent No.: US 7,694,713 B2
(45) Date of Patent: Apr. 13, 2010

(54) REINFORCED ALUMINUM ALLOY AND ITS PROCESS OF MANUFACTURE

(75) Inventors: Roberto Martinez Sanchez, Chihuahua (MX); David Rios Jara, Chihuahua (MX); Ivanovich Estrada Guel, Chihuahua (MX)

(73) Assignee: Centro De Investigacion En Materiales Avanzados, Inc, Chihualwa (MX)

( * ) Notice: Subject to any disclaimer, the term of this patent is extended or adjusted under 35 U.S.C. 154(b) by 542 days.

(21) Appl. No.: 11/434,297

(22) Filed: May 15, 2006

(65) Prior Publication Data

US 2007/0264149 A1 Nov. 15, 2007

(51) Int. Cl.
*B22D 19/14* (2006.01)

(52) U.S. Cl. ..... 164/97; 419/5

(58) Field of Classification Search ..... 164/91–112; 419/5, 61–65

See application file for complete search history.

(56) References Cited

U.S. PATENT DOCUMENTS 4,801,339 A * 1/1989 Osborn et al. ..... 419/29

OTHER PUBLICATIONS

ASM Handbook: vol. 7 Powder Metal Technologies and Applications, "Mechanical Alloying", "Infiltration", ASM Hancbooks Online, http://products.asminternational.org/hbk, 2002.*

* cited by examiner

*Primary Examiner*—Roy King
*Assistant Examiner*—Janelle Morillo
(74) *Attorney, Agent, or Firm*—Defillo & Associates, Inc.; Evelyn H. Defilló

(57) ABSTRACT

The present invention relates to a process for hardening an aluminum-based matrix alloy by the dispersion of metallized graphite (MG) with copper and optionally zinc or boron by the agitation in liquid state. By this means, the impregnating of MG particles (reinforcing phase) is increased, facilitating the homogenous distribution in the aluminum-base matrix alloy. The mechanical properties of aluminum or aluminum-based are increased alloys by the process of hardening by dispersion, without affecting the density and electrical conductivity of the alloy.

13 Claims, No Drawings

REINFORCED ALUMINUM ALLOY AND ITS PROCESS OF MANUFACTURE

FIELD OF THE INVENTION

The present invention relates to a process to produce composed materials of a metallic matrix to be used in the production of an electricity conductor cable. The product obtained is an alloy having an aluminum matrix, with reinforcing particles comprising of a mixture of graphite-copper, optionally zinc or boron, of which concentrations go from 0.02 to 0.42% in weight and through the technique described herein is uniformly dispersed in aluminum. The range in concentration of the reinforcement particles used in the present invention provides a new generation of composite materials: the micro-composites, and is carried out by means of the well-known technique called Powder Metallurgy (MP).

BACKGROUND OF THE INVENTION

Considerable efforts have been made in the investigation for the development of aluminum-based materials of high resistance, which would be able to satisfy the demands of advanced designs of the electrical industry.

The metallic matrix aluminum-based composites are under consideration due to the possibility that the addition of reinforcing particles, added to aluminum or its alloys, offers to improve the properties of aluminum and their alloys with respect to the elastic module, yield stress, maximum stress, and deformation.

In a general way, two main types of hardened aluminum-based alloys exist with particles as a second phase; one involves a heat treatment, while the other does not. In thermo handle alloys, fine particles of a second phase, commonly referred to as precipitated, produce products with high resistance and rigidity. This occurs when a solid supersaturated solution precipitates the excess of solute. This process is favored in alloy systems that present an increase in the solubility of the solute as the temperature is increasing too, in comparison with low or room temperature.

On the other hand, the hardening by dispersion in aluminum alloys non-thermo handle is based on the production of a fine distribution of incoherent particles of the second phase that hardens the aluminum matrix or its alloys preventing the movement of dislocations (plastic flow) due to their near spacing. In this case, the particles of the second phase have a small or null solubility in the solid state even at high temperature. This type of reaction is commonly referred to as hardening by dispersion. In both types of alloys it is desirable to maintain reinforcement particles of the secondary phase in a fine size (0.1-0.5 microns) and near spacing to obtain a good combination of hardness and resistance (Principios de Metalurgia Fisica, Roberto And Reed-Hill, Editorial CECSA, Chapter 9, page 323, 1980). These materials are produced by a heat treatment, which involves the dissolution of particles of the second phase in the metallic matrix, followed by the steps of solution and aging, which provides a fine distribution of precipitates of the secondary phase. Said precipitated, affects the resistance of the structure by restoration of tensions inside the metallic matrix.

It has been demonstrated, by theoretical and experimental considerations (International Journal of Materials and Product Technology, Vol 15, Nos. 3/4/5, pp 356-408, Dispersion-Strengthened Aluminum Prepared by Mechanical Alloying by M. Besterci), that the maximum effect of hardening is obtained by means of the following structural parameters:

a) The particle size of the reinforcing particles of the secondary phase (dispersoids) should not exceed 50 nm. The particles of larger size are of little significance from the point of view of the hardening.

b) The average distance among the reinforcement particles must be within the range of 100 to 500 nm and its distribution should be uniform, without presence of heterogeneity and conglomerates.

The Metallic Matrix Composites (MMC) are at the present, potential candidates for a great variety of applications, for example; structural applications, in the automotive industry and in the industry of the electrical conductors to mention some of them. Diverse techniques for the production of MMC can be used; these can be grouped into two main types depending on the state of the matrix during the manufacture process: solid or liquid route. Although the production of MMC by liquid metal processing is receiving great attention due to its relatively low cost, frequently the following disadvantages are presented:

i) heterogeneous distribution of particles of ceramics or fibers, due to the agglomeration and dendrite segregation that is a variation in concentrations on microscopic scale due to the different solidification points which present the elements or composites of an alloy, and that is generated during the solidification of alloys; and ii) undesirable chemical reactions in the inter-phase due to the high temperature of the fused material.

The liquid route is covered by conventional techniques of metallurgy (fusion and cast); the solid route is covered by Powder Metallurgy (PM). Additionally, the PM could include the processing of the initial materials by Mechanical Alloying (MA) and Mechanical Milling (MM). Also, new and novel materials can be produced by MA and MM, including metallic and ceramic. The MA can be defined as the dry milling of two or more elements or composites in a mill for obtaining nanometric materials such as powdered alloys or composites with homogenous multiphase dispersions. This process occurs by means of the repeated welding and fracture of a metallic and non-metallic powdered mixture using mechanically activated balls.

It has been established as the term "mechanical alloying" when pure elements are involved, and "mechanical milling" when powdered pre-alloyed are involved. The MA is a method to produce metallic powdered composites with a controlled fine microstructure and uniformity. This occurs by the phenomenon of fracture and subsequent welding of a powdered particle mixture during the milling with impact of high energy in a controlled environment, for example, in a ball type mill, in the presence of process control agent (optional) that prevents the agglomeration of particles. During the processing, the oxide shell generally present in the surface of the powdered particles is incorporated inside the particle of the composite and homogenously dispersed. In a similar way, the metallic and non-metallic components are also finely dispersed inside the powdered particles. The materials produced by MA are later consolidated by diverse routes, for example: sintered pressing, extrusion, rolling, cast, etc., only to mention some of them.

The MA and MM processes have been widely recognized as alternative routes in the formation of metastable phases for select applications. The MA and MM processes are novel techniques to produce advanced materials with unusual properties, due to the microstructure refinement, even in immiscible systems. In this way, combining PM with MA or MM, a new generation of materials can be obtained.

The necessity to increase the mechanical properties in aluminum alloy has motivated the study of the Composite Materials (CM) aluminum based. These materials are required due to their low density and high specific stiffness. In addition, the reinforcing ceramic particles significantly increase the wear resistance. By means of PM methods, it is possible to produce unique CM with an extremely fine distribution of particles of reinforcement, that otherwise would not be possible to obtain by means of the conventional techniques of metal and alloys molding.

The CM are usually produced when mixing non-metallic reinforcing particles such as sands, powder, fibers, or similar within a metallic matrix. For example, MC aluminum-based, are basically formed from aluminum or of a commercial aluminum alloy (namely 1350, 6061, 2024, A356, etc.) reinforced with ceramic particles such as silicon carbide or powder of aluminum oxide.

In spite of the growing market, the high manufacture cost of the composite materials (CM) has limited their availability to be competitively evaluated with the non-reinforced metallic materials. Traditionally, the manufacture of CM, has employed techniques related to the Powder Metallurgy (PM), such as the compaction of particle mixtures or ceramic fibers and powdered aluminum. Unfortunately, the high cost of powdered metals, pyrophoric risks, and burst associated with the handling of great amounts of powder, have avoid a significant reduction in the cost of CM produced by these routes. Additionally, the use of liquid metal in the production of CM has been limited to the infiltration in ceramic preform. Similarly, the mixture of ceramic materials inside liquid Aluminum using agitation methods, has not been advantageous due to problems of impregnation of the liquid in the fine particles (wettabillity of particles), which have a great surface area, joining the quick oxidation of the liquid aluminum, highly reactive, during the agitation.

There are several methods or variants in the process of agitation in liquid state, for example compo casting and others more sophisticated, such as the one reported in the U.S. Pat. No. 6,491,423 entitled "Apparatus for Mixing Particles into Liquid Medium" by M. D. Skibo and D. M. Schuster. However, the main problem still continues to be the incomplete, low or null impregnating (wettabillity) of the reinforcing particles. By means of the present invention, the impregnation is increased considerably and the incorporation of the reinforcing particles inside the aluminum matrix or its alloys is facilitated. Also, the oxidation of reinforcing particles is prevented by the preparation or pre-conditioning in which they are submitted, as explained further on.

The main problem with many conventional aluminum alloys is, when the requirements of density and mechanical resistance, are reaching they are not enough ductile to be usable. Also, these aluminum alloys of high mechanical resistance do not fulfill the minimum requirements of conductivity to be able to be used in electrical applications.

The aluminum-base alloy obtained according to the process of the present invention presents high mechanical resistance and at the same time maintains the aluminum intrinsic properties, for example density, % of elongation (ductility) and electrical conductivity.

DETAILED DESCRIPTION

The present invention concerns a metallic aluminum matrix alloy system, hardened by the dispersion in its interior by a mixture of graphite-copper and optionally zinc or boron, which is characterized by its greater mechanical resistance, greater yield stress, maximum stress in tension, as well as very similar values of density and high electrical conductivity with respect to aluminum and commercial aluminum alloys utilized at the present.

The present invention is related to the substantial improvement in the mechanical properties of aluminum alloys without affecting its basic properties of specific interest, such as maximum strength, density and mainly, electrical conductivity.

The essential components of the alloy hardened by the dispersion of reinforcing particles according to the present invention are: aluminum or any commercial aluminum-base alloy used for the production of an electrical cable, for example 1350 or 6201 and metallized graphite (MG) mainly with copper and optionally with zinc or boron. Other elements can be present, such as silicon, magnesium, manganese, copper, iron etc., especially when the reinforcing process is made in another type of aluminum alloys.

It is pertinent to mention that due to the components used in the present invention, similar words have been found in some patents; however, considerable differences exist between the present invention and the patents found; for example, U.S. Pat. No. 5,722,033 entitled "Fabrication Methods for Metals Matrix Composites" by Robin A. Carden, discloses an aluminum-base composite having boron carbide, nevertheless, the main interest of this patent is the extrusion process. U.S. Pat. No. 5,667,600 entitled "Aluminum Alloys Containing Beryllium and Investment Casting of such Alloys" by Fritz C. Grensing, James M. Marder and Jere H. Brophy, in spite of coinciding in some words, does not present any similarity with the present invention. U.S. Pat. No. 4,929,513 entitled "Preform for Wire for a Carbon Fiber Reinforced Aluminum Material Composite and for Method Manufacturing the Same", by Tetsuyuki Kiono, Seiichiro Ohnishi, Tohru Hanano and Tohru Hotta; the JP Patent No. 1490085/87 "A Preform for a Wire for a Carbon Fiber Reinforced Aluminum Material Composite and a Method Manufacturing the Same", by Tetsuyuki Kiono, Seiichiro Ohnishi, Tohru Hanano and Tohru Hotta; and JP Patent No. 63312924 "Wire Preform for Carbon Fiber Reinforced Aluminum Composite Material and Production Thereof", by Tohru Hanano, mention the term "graphite", however, the objective of these patents is the manufacture of a preform (skeleton) of graphite fibers which are filled with an aluminum alloy. Finally the U.S. Pat. No. 4,023,252 by Moses A. Levistein and Edward J. Bauerfeld, utilizes metallized graphite with nickel in a copper-base alloy (90-95% in weight of copper).

The process according to the present invention for the production of the aluminum alloy reinforced with graphite-copper and optionally zinc or boron, is characterized by the following steps:

a) preparation of a mixture (that will reinforce the final alloy) of graphite powdered with copper powdered, optionally zinc or boron, but preferably copper, by means of mechanical milling and/or mechanical alloying, under an inert atmosphere of nitrogen or argon to avoid the oxidation. The proportion of copper, zinc, or boron: graphite is within the interval from 0.15 to 6.0% in weight. The fineness of the powder obtained is between 0.1 and 0.5 microns.

b) pulverizing aluminum composites to ~70 microns (−200 meshes) between 0.3 and 10 hours, in an inert atmosphere of argon or nitrogen, preferably argon, since argon is an inert gas and helps to avoid oxidation.

c) adding the product of the step (a) to the product of the step (b) and grind it in a ball mill or vanes mill of high energy by a period of 0.3-6 hours, preferably 2 hours, in an inert atmosphere of argon or nitrogen, preferably argon, to avoid oxidation.

d) adding the product of the step (c), to an aluminum composite in liquid state, in an inert atmosphere of argon or nitrogen, preferably argon, to avoid oxidation.

e) In order to avoid the agglomeration of the particles in the steps (a) and (b), anti-agglomerative agents are used such as methanol, ethanol, polyethylene glycol, boric acid, stearic acid, hexane, benzene, and ciclohexane; preferably methanol since it is a small molecule and volatile.

Production of Metallized Graphite

The MG can be produced by means of mechanical milling with balls of a mixture of metallic powder and powdered graphite. The working metal used was copper; the reason for selecting Cu like metallizing material instead of nickel (P. K. Rohatgi, U.S. Pat. No. 5,626,692), is because copper presents an excellent adhesion on graphite. Additionally, at low concentrations, copper forms a solid solution with the aluminum. Which, added to the excellent adhesion which copper and graphite have, facilitates that the particles of this last one (graphite) to be perfectly incorporated to the aluminum matrix. However it is possible to use nickel (Ni), zinc (Zn) or boron (b) or its alloys like the metallizing material of the graphite; nevertheless the copper presents a better adhesion to the graphite than any other mentioned metal.

The copper or metallizing material employed must be in powdered form, with fine particle size (0.1-0.5 microns) and high purity. For the case of copper, copper obtained from hydrated or anhydrous cupric salts such as: $CuCl_2$, $CuCl_2.2H_2O$, $CuCl_2.2NH_4Cl.2H_2O$, Cu $(NO_3)_2.3H_2O$, Cu $(NO_3)_2.6H_2O$, $CuSO_4$, $CuSO_4.5H_2O$, preferably copper sulfate penta hydrated ($CuSO_4.5H_2O$), the recommended Cu:C proportions range from 0.15 to 6.0% in weight. The metallized graphite (MG) can be produced by high energy balls during different times. The recommended intervals are 0.3-10 h; while more prolonged, it is the milling time, more fine metallized graphite particles (MG) are obtained. The preferable time of milling is between 4-6 hours in an inert nitrogen or argon atmosphere to avoid oxidation, preferably argon. In order to insure that the particles are not agglomerate and a fine powder is obtained, it is possible to add methanol, ethanol, polyethylene glycol, boric acid, stearic acid, hexane, benzene, ciclohexane, etc., as process control agents (ACP), preferably methanol. The millings are carried out with addition of 0.05 to 2.5 milliliters of the ACP by each 50 grams of powder.

Synthesis of the Powdered Aluminum-Based Composite

If the metallized and finely pulverized graphite, obtained in the previously described step, is added as found at this time to the melted aluminum at 700-800° C., it will combust prior to arriving at the surface of the liquid aluminum and become part of the waste (scoria) and would never be incorporated to the aluminum matrix. In order to avoid this, the MG is ground with powdered aluminum to protect it from the temperature and oxidation as is described subsequently.

The MG is incorporated in powdered aluminum, forming large particles produced by mechanical milling of the aluminum and MG. In simple words, the MG is encapsulated inside the aluminum particles; by means of this procedure the incorporation of the reinforcing particles (MG) inside aluminum matrix or its alloys in the liquid state is facilitated. Once incorporated, it will remain inside until the solidification. As beginning materials were employed powdered Al (99.9% of purity, ~70 microns (mesh −200) and the previously metallized graphite (0.1-0.5 microns). Different compositions of MG were studied, as was previously mentioned, and different mixtures of aluminum-based composites were obtained as shown in Table 1.

Each mixture was mechanically processed in a high energy balls mill type "shaker" (SPEX-8000), or in a horizontal mill with internal vanes also of high energy (Simoloyer) during 0.3-6 h; preferably 2 hours. It is recommended to use argon (Ar), nitrogen ($N_2$) or any inert atmosphere, it is preferably Ar. The devices and milling media are made from hardened steel. The milling media-to-powder weight ratio was 5:1 for the SPEX mill and 20:1 for the Simoloyer mill. Methanol or stearic acids were employed as ACP, preferably methanol, since, as previously mentioned, methanol it is a small molecule and is also volatile. All the milling runs were carried out under two conditions: with addition of the ACP and without addition of the ACP. It is recommendable that the use of the ACP is omitted in order to avoid the excessive refinement of the aluminum particles or its alloys.

Table 1 shows the aluminum-MG capsules nomenclature, the copper and graphite concentrations, and the alloy used. In this Table "Balance" means the complimentary amount necessary to obtain 100% of the aluminum-based composite and must be the alloy that it intends to reinforce.

TABLE 1

Powdered aluminum-MG composition produced by mechanical milling, using as an example the commercial Aluminum alloy 1350.

| Composition* | $Cu_{[\%\ weight]}$ | $C_{[\%\ weight]}$ | Balance |
|---|---|---|---|
| Al alloy −0.5% MG | 0.325 | 0.175 | Alloy 1350 |
| Al alloy −1.0% MG | 0.650 | 0.350 | Alloy 1350 |
| Al alloy −1.5% MG | 0.975 | 0.525 | Alloy 1350 |
| Al alloy −2.0% MG | 1.300 | 0.700 | Alloy 1350 |

Cu:C relation = 65:35

*The same composition was utilized for different Cu:C relations, as was previously mentioned.

As previously mentioned, the aluminum capsules (or aluminum alloy)—metallized graphite are added to a broth of an aluminum alloy to produce the composed materials. It is to be considered that each alloy will present a balance according to its nomenclature, for the present invention, is taken as an example the AA 1350 alloy, (International designation); hereafter called 1350 alloy. However, it should be noted that the main reinforcing element is the graphite, which shows certain relation to the composition of copper, as shown in the data in Table 2, and according to the relation that presents the graphite and copper for the given example.

Table 2 shows the composition of composites based in aluminum alloy case produced by the agitation of pure aluminum or its alloys in the liquid state, taking as an example the 1350 alloy. As in Table 1, "Balance" means the complimentary amount necessary to obtain 100% of the aluminum-base composite and it is necessary that it is the alloy that it is intended to reinforce.

TABLE 2

Concentration of components in composites Aluminum-MG produced by stir casting, using as a comparative example the 1350 alloy.

| Nomenclature | $Cu_{[\%\ weight]}$ | $C_{[\%\ weight]}$ | Balance |
|---|---|---|---|
| 1350-05C | 0.055-0.130 | 0.030-0.070 | Alloy 1350 |
| 1350-10C | 0.148-0.222 | 0.080-0.120 | Alloy 1350 |
| 1350-15C | 0.241-0.315 | 0.130-0.170 | Alloy 1350 |
| 1350-20C | 0.334-0.408 | 0.180-0.220 | Alloy 1350 |
| 1350-25C | 0.427-0.501 | 0.230-0.270 | Alloy 1350 |

TABLE 2-continued

Concentration of components in composites Aluminum-MG produced by stir casting, using as a comparative example the 1350 alloy.

| Nomenclature | $Cu_{[\%\ weight]}$ | $C_{[\%\ weight]}$ | Balance |
|---|---|---|---|
| 1350-30C | 0.519-0.594 | 0.280-0.320 | Alloy 1350 |
| 1350-35C | 0.612-0.687 | 0.330-0.370 | Alloy 1350 |
| 1350-40C | 0.705-0.779 | 0.380-0.42 | Alloy 1350 |

Cu:C Relation = 65:35

*The same composition was utilized for different Cu:C ratios, as was previously mentioned.

The new nomenclature only takes into consideration the graphite content, in view that copper is an element present in the aluminum alloys under study submitted to the reinforcing process by dispersion. The range in the copper content will be, therefore, the product of the sum of the content of Cu in the aggregated metallized graphite (MG) plus the original content of Cu in the aluminum alloy.

The products obtained by mechanical milling (MM) present the shape of thin flakes, if these are produced with the Simoloyer mill and the shape of large spherical particles (0.5-1 mm), if they are produced in the SPEX mill. The product of MM comprises MG homogenously distributed inside the large particles of the aluminum-base alloy, hereafter called Aluminum-MG. The MM process has an additional favorable effect on the impregnating of MG by the aluminum matrix.

The powders obtained by MM of Aluminum-GM are subsequently added over the surface of a liquid bath of the aluminum alloy, which is content in a crucible at temperature of 700-800° C. Inside the melted alloy is a vane type impeller made with a tool grade steel that is prompted by means of an arrow connected to an electrical motor with speed variable system. The vortex formed by the rotation of the impeller suctions the Aluminum-MG particles inside the melted metal and the friction developed between the impeller and crucible walls favors the impregnation of the GM particles. Additionally, to avoid the oxidation of the MG, a permanent flow of nitrogen or argon is maintained upon the surface of the melted aluminum alloy.

In view that the MG is added to the melted material inside large particles produced by MM, the MG is then protected against the oxidation increased by the high temperature of the liquid metal.

The temperature of the liquid aluminum alloy was maintained between 700-800° C. with the aid of a system of external heating. After the agitation and doping with MG, the produced composite still in liquid state, was introduced in a preheated oven to the previous temperature and maintained in the interior for 10 minutes, to return to reach the optimal cast temperature of the aluminum alloys. Before the solidification in a mold, an additional agitation was carried out using the impeller previously described for approximately one minute.

A convenient alternative route, to carry out the addition of particles of Aluminum-GM to the aluminum-base alloy, can be implemented during the fusion in an induction oven; this modification can be implemented for a continuous casting process.

The composite developed in the present invention comprises concentrations from 0.02 to 0.42% in weight of graphite (maintaining the Cu:C proportions previously mentioned) and an aluminum-base alloy balance. In Table 2 the interval of compositions used in the present invention in the production of composites by agitation in liquid state is presented, as well as the used nomenclature, taking as its basis the 1350 aluminum.

The function of the addition of metallized graphite (MG) to the 1350 aluminum-base alloy is to improve the mechanical resistance at both, room temperature and high temperature, keeping the intrinsic properties of the alloy, such as, ductility (% of elongation), maximum resistance, and electrical conductivity. As examples of the improvements in the mechanical properties, the yield stress has been increased to around 30%, the maximum resistance to the tension has been increased by nearly 38%, with respect to alloy 1350; this value in the mechanical resistance is maintained and in some cases increased after the wiredrawing (pulling through a die by means of a tensile force at room temperature to produce wires).

It is important to notice that a similar behavior in the ductility is maintained in comparison with the 1350 alloy in the same processing conditions, and the values of electrical resistivity found have been maintained inside the acceptable limit for their use in electrical conductors; this is, the volumetric electrical resistivity values are less than 0.028080 $\Omega$-mm$^2$/m.

In accordance with the present invention, aluminum-based composites hardened by dispersion is presented, which is characterized by its high mechanical resistance, increased yield stress ($\sigma_o$), higher maximum resistance to tension, and similar density compared with the original aluminum-base alloy (1350) without dispersion treatment. Adding to this, electrical resistivity values are within the required intervals for its application as electrical aluminum-base conductive wires.

Tables 3 and 4 show comparative values of those found in various composites noted in the tables as "example" and the 1350 alloy. Table 3 shows maximum stress ($\sigma_{max}$) yield stress ($\sigma_y$), and the Young modulus; whereas Table 4 shows the results of electrical resistivity, density and linear weight.

TABLE 3

Specific values in the tension tests for the aluminum-based (1350) composites, units in $Kg_F/mm^2$.

| Sample | ($\sigma_{max}$) [$Kg_F/mm^2$] | ($\sigma_y$) [$Kg_F/mm^2$] | Young Modulus [$Kg_F/mm^2$] |
|---|---|---|---|
| Alloy 1350 | 8.806 | 4.399 | 7033.49 |
| Example 1 | 11.000 | 5.592 | 7008.51 |
| Example 2 | 11.632 | 5.663 | 5987.88 |
| Example 3 | 11.993 | 5.620 | 6883.39 |
| Example 4 | 10.437 | 4.856 | ND |
| Example 5 | 12.137 | 5.688 | 7393.15 |
| Example 6 | 13.621 | 6.210 | 5826.25 |
| Example 7 | 9.640 | 4.812 | 6559.94 |
| Example 8 | 10.608 | 5.763 | 6868.61 |
| Example 9 | 11.191 | 5.750 | 7256.10 |

Reported Young Module for aluminum alloys: 7,030 $Kg_F/mm^2$.
ND: Not Determined

TABLE 4

Measurements made to the composites that involve electrical resistivity, density, and linear weight of wire rod employed in all the previous measurements, metric units.

| Sample | Resistividad ($\Omega$ mm$^2$/m) | Density (g/cm$^3$) | Lineal weight g/cm |
|---|---|---|---|
| Alloy 1350 | 0.02808 | 2.7000 | 1.75 |
| Example 1 | 0.02501 | 2.7065 | 1.74 |
| Example 2 | 0.02475 | 2.7099 | 1.70 |

TABLE 4-continued

Measurements made to the composites that involve electrical resistivity, density, and linear weight of wire rod employed in all the previous measurements, metric units.

| Sample | Resistividad ($\Omega$ mm$^2$/m) | Density (g/cm$^3$) | Lineal weight g/cm |
|---|---|---|---|
| Example 3 | 0.02501 | 2.7103 | 1.77 |
| Example 4 | 0.02628 | 2.7054 | 1.74 |
| Example 5 | 0.02416 | 2.7163 | 1.75 |
| Example 6 | 0.02416 | 2.7227 | 1.75 |
| Example 7 | 0.02406 | 2.7027 | 1.74 |
| Example 8 | 0.02289 | 2.7063 | 1.70 |
| Example 9 | 0.02442 | 2.7100 | 1.70 |

Although the present invention has been described in a general way, it will be understood that the modifications and variations are considered inside the prior view and the reach of the invention and the following claims.

What is claimed is:

1. A process to produce a reinforced aluminum alloy comprising the steps of:

a) preparing a mixture of a powdered graphite with a powdered copper, optionally zinc or boron, by at least one of mechanical milling or mechanical alloying, in an inert atmosphere of nitrogen or argon;

b) pulverizing aluminum to 70 microns (−200 meshes) during 0.3 to 10 hours, in an inert atmosphere of argon or nitrogen;

c) encapsulating the graphite mixture inside the aluminum by adding the product of step a) to the product of step b) and grinding it during 0.3 to 6 hours in an inert atmosphere of argon or nitrogen;

d) optionally adding to the product of step a) and step b) an anti-agglomerate agent chosen from methanol, ethanol, polyethylene glycol, boric acid, stearic acid, hexane, benzene, or ciclohexane prior to step c); and e) adding to the product of the step d) to aluminum in liquid state, in an inert atmosphere of argon or nitrogen.

2. The process according to claim 1 wherein a copper, zinc, or boron: graphite proportion is 0.15 to 6.0% in weight.

3. The process according to claim 1 wherein the product of step a) has a fineness of 0.1 to 0.5 microns.

4. The process according to claim 1 wherein the mechanical milling step lasts between 0.3 to 10 hours, and wherein the mechanical milling is performed in an inert atmosphere of argon or nitrogen.

5. The process according to claim 1 wherein the product of step a) has a proportion of 0.02 to 0.42% in weight of graphite and 0.037 to 0.80% in weight of copper, zinc, or boron.

6. The process according to claim 1 wherein the aluminum of step e) is fused to a temperature between 700-800° C., under at least one of mechanical, thermal, or magnetic agitation.

7. The process according to claim 1 wherein the copper of step a) can be obtained from a hydrated or anhydrous cupric salt selected from the group consisting of CuCl2, CuCl2.2H2O, CuCl2.2NH4Cl.2H2O, Cu(NO3)2.3H2O, Cu(NO3)2.6H20, and CuSO4, CuSO4.5H2O.

8. The process according to claim 7 wherein hydrated or anhydrous cupric salt is CuSO4.5H2O.

9. The process according to claim 1 wherein the milling time of step a) is between 4 to 6 hours.

10. The process according to claim 1 wherein the concentration of the product of step a) is equal or less than 1.2% in weight with respect to the concentration of the product of step e).

11. The process according to claim 1 wherein the production of the alloy of step e) is carried out according to the following conditions:

a) adding slowly the product of step c) to the liquid aluminum of the stage e) in a crucible to temperature between 700-800° C.;

b) shaking constantly the mixture of the previous step to variable speed to obtain a homogenous mixture; and c) passing an argon or nitrogen current over the surface of the alloy obtained in the previous step until its solidification.

12. A process to produce a reinforced aluminum alloy comprising the steps of:

a) preparing a mixture of a powdered graphite with a powdered copper, optionally zinc or boron, by at least one of mechanical milling or mechanical alloying, in an inert atmosphere of nitrogen or argon to produce a metalized graphite;

b) pulverizing aluminum in an inert atmosphere of argon or nitrogen;

c) encapsulating the graphite mixture inside the aluminum by adding the product of step a) to the product of step b) and grinding it during 0.3 to 6 hours in an inert atmosphere of argon or nitrogen; and d) adding the encapsulated graphite to aluminum in liquid state, in an inert atmosphere of argon or nitrogen.

13. A process to produce a reinforced aluminum alloy comprising the steps of:

a) preparing a mixture of a powdered graphite with a powdered copper, optionally zinc or boron, by at least one of mechanical milling or mechanical alloying, in an inert atmosphere of nitrogen or argon to produce a metalized graphite, wherein the relation Cu:C is 65:35 b) pulverizing aluminum in an inert atmosphere of argon or nitrogen;

c) encapsulating the graphite mixture inside the aluminum by adding the product of step a) to the product of step b) and grinding it during 0.3 to 6 hours in an inert atmosphere of argon or nitrogen; and d) adding the encapsulated graphite to aluminum in liquid state, in an inert atmosphere of argon or nitrogen.

* * * * *